United States Patent [19]

Jaymes et al.

[11] 4,154,210

[45] May 15, 1979

[54] WOOD FIRED FURNACE

[76] Inventors: John B. Jaymes, R.D. #1; James A. Kling, Main St., both of Alexandria, Pa. 16611

[21] Appl. No.: 827,320

[22] Filed: Aug. 24, 1977

[51] Int. Cl.[2] ..... F24C 13/00; F28B 15/00

[52] U.S. Cl. ..... 126/34; 122/262; 126/72; 126/245

[58] Field of Search ..... 126/5, 34, 35, 31, 132, 126/242, 245, 243, 72, 164, 165, 121, 122, 290, 101; 237/51; 122/262, 264

[56] References Cited

U.S. PATENT DOCUMENTS

| | | | |
|---|---|---|---|
| 128,624 | 7/1872 | Holbrook | 126/290 |
| 135,236 | 1/1873 | McDonald | 122/264 |
| 222,653 | 12/1879 | Boyd | 126/132 X |
| 834,444 | 10/1906 | Bauscher et al. | 122/264 |
| 912,980 | 2/1909 | Evans | 126/243 |
| 1,778,694 | 10/1930 | Silva | 126/242 |
| 1,887,041 | 11/1932 | Remy | 126/243 |
| 2,660,997 | 12/1953 | Chesser | 126/245 |
| 3,635,211 | 1/1972 | Englery | 126/121 |

FOREIGN PATENT DOCUMENTS

| | | | |
|---|---|---|---|
| 978392 | 12/1964 | United Kingdom | 126/121 |

OTHER PUBLICATIONS

"Fireplace Furnace: Heating Your House," *Popular Mechanics*, Oct. 1974, pp. 154–156.

*Primary Examiner*—William F. O'Dea
*Assistant Examiner*—Harold Joyce
*Attorney, Agent, or Firm*—Thomas E. Sterling

[57] ABSTRACT

This invention comprises a furnace heating device having a fire box and hollow tubing extending longitudinally through the internal portion of said fire box through which a heating medium is circulated to outside radiators. The fire box has an ash drawer extending through the bottom portion of the fire box adjacent to the coiled tubing.

8 Claims, 5 Drawing Figures

WOOD FIRED FURNACE

This invention relates to a furnace device and in particular to a furnace device utilizing internal tubes containing a heating medium. The heating medium can be either liquid or air.

The purpose of this invention is to utilize a renewable resource (wood) for heating. The furnace can be used as a sole source of heat, with a back-up oil or gas fired system, or as an occasional or emergency heat source. An oil-fired or gas get can be added to the furnace to make it a system complete in itself that will give optional methods of fuel sources. Still another possible use for this furnace would be as a back-up to a solar heating system.

The furnace is used as a "slow-burning" wood furnace heating water for a water medium heating system or heating air for an air-medium heating system. The furnace can be used as a sole source of heat or connected with either an existing hot water or hot air heating system. Water is the most efficient heating medium and hereafter the description will refer to a water system; however, air can also be heated and used. The furnace utilizes a water circulator (continuous operation), pressure release valves, and automatic water-adding device found in existing hot water heating systems. When the furnace is added to existing systems, proper connectors must be made—and the water circulator wired to run continuously, or thermostatically controlled.

Firebox

The interior of the firebox is lined with water-holding steel tubes. The water is circulated through these tubes and heated. The length of the firebox is approximately 36 inches, and the width is 24 inches, and the height is 30 inches. The furnace is constructed to control the amount of draft introduced so that it will efficiently burn wood at a slow rate. In the test model, there was one fire-lighting per season and the fire burned up to thirty hours with one filling.

Slow-burning stoves are available: the unique feature of this firebox is that is uses pipes to heat water. The fire practically surrounds the water being heated.

Ash Clean-Out

The ash drawer fit under the firebox; the water tubes act as a grate. The "drawer" is upside down. The "bottom" of the drawer is under the pipes and holds the coals against the pipes. When the drawer is pulled out, the ashes fall into the tray. The drawer is turned over and the end is out so that the ashes are scooped into the drawer when it is inserted into the tray. The drawer is then pulled out and the ashes are emptied. In a four-month period, only twenty gallons of ashes were removed from the furnace. The combustion of the wood is almost complete.

Uniqueness of this Invention

The firebox is unique in that is permits the water-filled tubes to be heated in a more efficient manner than if the furnace used the water-jacket principle. The tubes are surrounded by wood coals; more surface area is exposed to the heating source. The water-jacket principle is similar to heating water on top of a stove. The tube principle is running the water through the fire. In the above-described firebox, approximately 60 feet of water-filled pipes are exposed to direct heat. Returning cooled water is circulated into the "core" of the firebox and hot water is circulated out of the firebox into the heating system. There is a continuous circulation of the water.

An object of this invention is to provide a slow-burning wood furnace lined with water containing metal tubes.

Another object of the invention is to provide a slow-burning furnace which will utilize wood as a heating fuel.

Yet another object of this invention is to utilize water-filled pipes within the firebox, said pipes being exposed to the furnace coals.

Still another object of this invention is to provide an efficient hot-water-type furnace which burns wood as a fuel.

Figure 1:
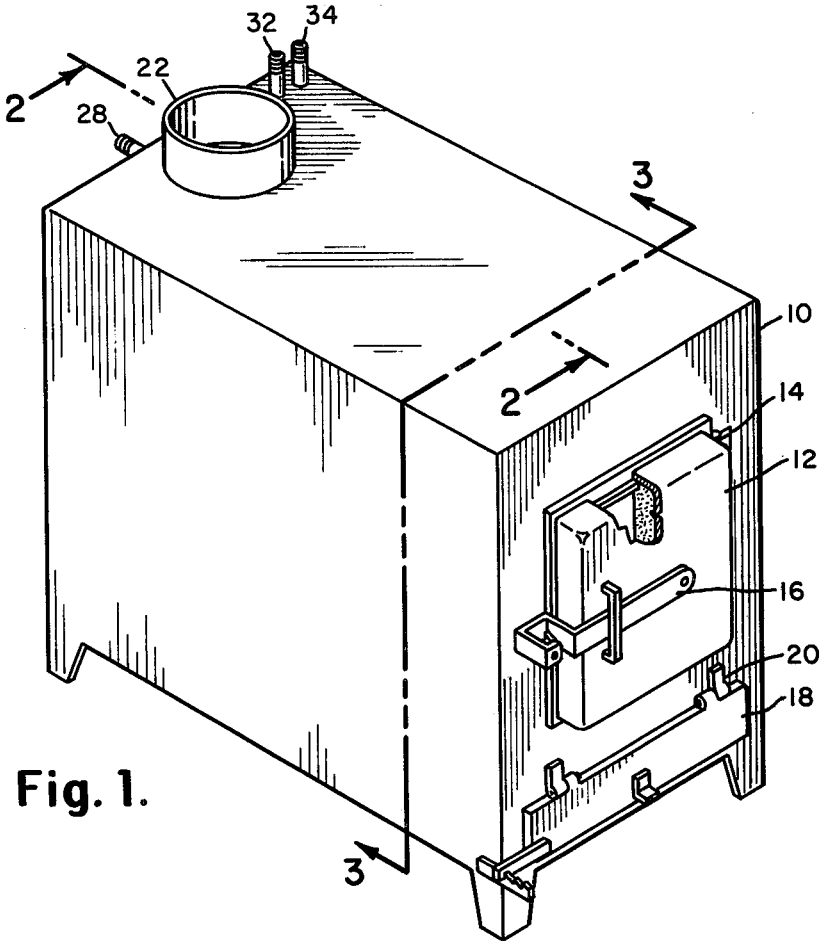
FIG. 1 is a perspective view of the invention showing the outer portion of the firebox.
Figure 2:
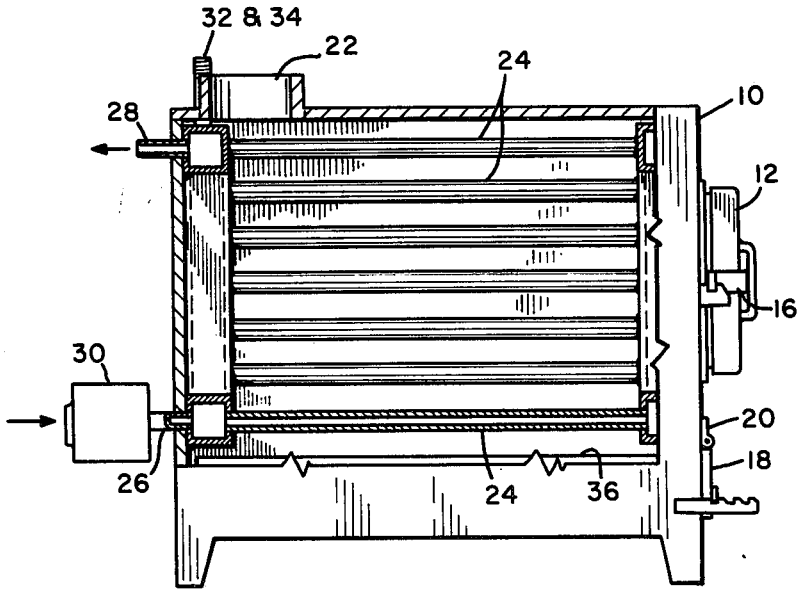
FIG. 2 is a side view of the invention taken along line 2—2 of FIG. 1.

Referring now to the drawings, 10 represents the firebox of the general shape of a rectangular prism, having a door 12 in the front portion therein mounted upon firebox 10 by hinges 14 and a door fastener 16 pivotally mounted upon door 12. An ash drawer 18 is mounted on firebox 10 by hinges 20 and positioned below door 12. A chimney 22 is positioned on the upper rear portion of firebox 10 and extends into the interior thereof.

The interior of the furnace is comprised of a front jacket 11 and a rear jacket 13 positioned at the front and rear of the firebox 10. Front jacket 11 and rear jacket 13 are comprised of square-shaped hollow tubing welded into a rectangular form. Hollow tubing 24 is butt-welded between front jacket 11 and rear jacket 13 so as to form the bottom grate and sides of the interior of firebox 10. Thus, the heating medium, usually water, is free to fill and circulate the system comprised of front jacket 11, hollow tubing 24 and rear jacket 13. An inlet pipe 26 is connected to the bottom portion of rear jacket 13 and a water pump coupled to inlet pipe 26 so as to pump water or other heat transfer medium into rear jacket 13. An outlet pipe 28 is in communication with the top portion of rear jacket 13 and is connected to a radiator system (not shown) for heating a building or other structure. Thus, as may be seen, cold water enters through pump 30, is heated within hollow tubing 24, front jacket 11 and rear jacket 13, and leaves the rear jacket 13 through outlet pipe 28.

The top portion of rear jacket 13 is connected to a thermometer on outlet pipe 32 which contains a thermostat (not shown) for determining the temperature of the water within rear jacket 13. Likewise, the upper portion of rear jacket 13 is connected to a pressure safety valve outlet 34 which contains a fluid pressure relief device (not shown) which will allow water under pressure to leave the system should the pressure within exceed a predetermined amount. This, of course, is done to protect the system from exploding from internal pressure. In some installations, the water pump 30 may be omitted and the water or other fluid allowed to circulate by convection currents.

Figure 4:
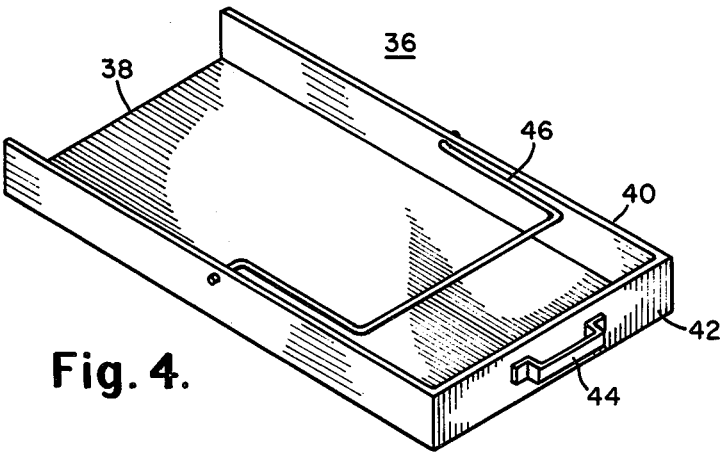
FIG. 4 is a perspective view of the ash drawer of the invention.

Referring now to FIG. 4, 36 is the ash drawer which is positioned within ash drawer 18 at the bottom of firebox 10. Ash drawer 36 is a drawer-like structure, having a bottom plate 38, two side pieces 40 extending perpendicularly therefrom and a front piece 42 extending perpendicularly from bottom plate 38 and attached to side pieces 40. A handle 44 is attached to the outward portion of front piece 42 and a hand loop 46 is pivotally attached to both side pieces 40. Ash drawer 36 is positioned on the interior bottom of firebox 10 with side pieces 40 resting on the bottom of firebox 10 and several inches below hollow tubing 24 on the bottom interior portion of firebox 10.

Figure 3:
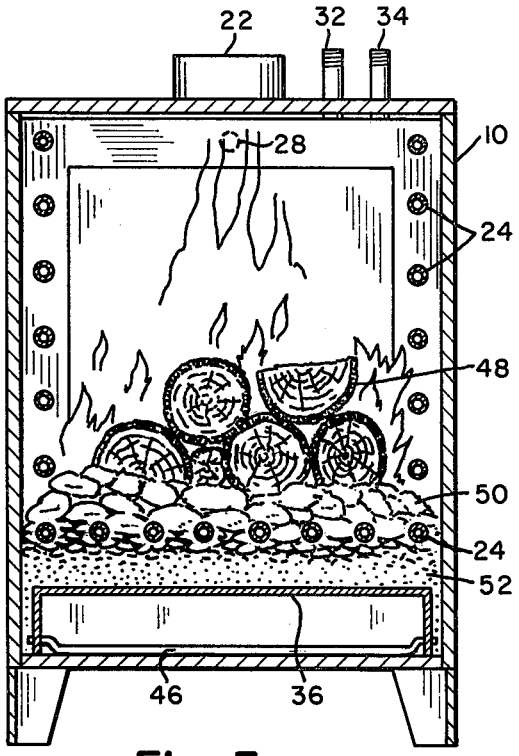
FIG. 3 is a front view of the invention taken along line 3—3 of FIG. 1 showing the burning logs in position.
Figure 5:
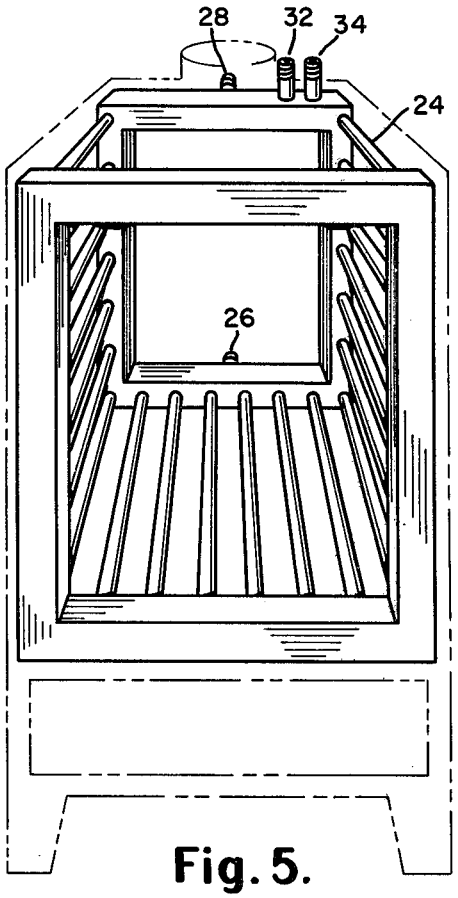
FIG. 5 is a front view of the invention with the front portion of the firebox removed.

Referring now to FIG. 3, wooden logs 48 are shown burning within firebox 10 with the smoke going out of chimney 22. Wooden logs 48 are resting upon glowing coals 50 which surround hollow tubing 24. Wood ashes 52 are resting upon bottom plate 38 of ash drawer 36.

In operation, a wood fire is constructed within firebox 10 on hollow tubing 24 positioned in the bottom portion of firebox 10. Hollow tubing 24 acts as a grate upon which wooden logs 48 rest. The longitudinal positioning of hollow tubing 24 permits wooden logs 48 to be easily slid within firebox 10. When the logs 48 are burning, the flames will envelope hollow tubing 24 on the interior sides of firebox 10 and heat the water therein. Likewise, the hollow tubing 24 upon which the wooden logs 48 rest, will become surrounded by glowing coals which will also heat the water in hollow tubing 24. The water within hollow tubing 24 is circulated through hollow tubing 24 by means of water pump 30 to radiators (not shown) for a portion of the heating system. It should be noted that the surface of hollow tubing 24 is exposed to intense heat within firebox 10 by direct exposure to the fire as is the surface of front jacket 11 and rear jacket 13. A thermometer (not shown) within thermometer outlet 32 indicates the temperature of the water within hollow tubing 24. The pressure safety valve outlet 34 containing a pressure valve (not shown) will open, should water pressure within hollow tubing 24 become too high. The ash drawer door 18 may be differentially opened to allow the proper draft for the fire within firebox 10.

When ash removal becomes necessary, handle 44 of ash drawer 36 may be pulled outwardly, allowing the ashes to fall on the bottom of firebox 10. The ash drawer 36 then may be inverted and thrust in the bottom of firebox 10 to scoop out the ashes therein. Several scoops may be necessary to remove these ashes, following which the ash drawer 36 is again inverted so that bottom plate 38 is uppermost and the ash drawer 36 inserted through ash drawer door 18 into the bottom of firebox 10.

As may be seen, the hollow tubing 24 on the bottom and side portions of firebox 10 acts both as a grate to support the fire and as a mechanism for heat transfer. Likewise, it is within the comtemplation of this invention that front jacket 11 and rear jacket 13 may be omitted and that the bottom and side portions of the interior of firebox 10 may be comprised of hollow tubing 24 which is alternately looped from the front to the rear of firebox 10. In such an arrangement, cold water would be forced through inlet pipe 26 through the hollow tubing 24, circulated through the hollow tubing 24 along the bottom and sides of the furnace and exit through outlet pipe 28.

Although a rectangular firebox is shown and described, it is within the contemplation of the invention that the firebox may be cylindrical, having hollow tubing extending longitudinally within the cylinder. Likewise, it is within the comtemplation of this invention that hollow tubing 24 may be positioned through the internal upper portion of firebox 10 as well as on the sides and bottom.

This invention may be used in any hot water heating system where wood is available for fuel. In such cases, great conservation of other heating fuels, such as coal, gas or oil is had.

We claim:

1. A furnace device having a fire box therein adapted to contain burning fuel and coals, comprising in combination:
   - a hollow front jacket positioned in the forward portion of said fire box;
   - a hollow rear jacket positioned in the rear portion of said fire box;
   - hollow tubing extending between said front jacket and said rear jacket, along the bottom and side portions of said fire box, said tubing being in continuous supporting contact with said coals and burning fuel;
   - a heating medium within said hollow front jacket, said hollow rear jacket, and said hollow tubing;
   - an inlet orifice connected to the bottom portion of said hollow rear jacket;
   - an outlet orifice positioned on the upper portion of said hollow rear jacket;
   - an ash drawer positioned adjacent to said hollow tubing on the bottom portion of said fire box, said ash drawing comprising in combination:
     - (1) a top plate positioned adjacent to said hollow tubing, said top plate being in continuous supporting contact with said coals and said burning fuel;
     - (2) two (2) lateral side plates attached to and extending downwardly from said top plate and resting upon the bottom of said furnace device;
   - a front plate attached to said top plate and said two (2) lateral side plates and extending downwardly from said top plate.

2. The combination as claimed in claim 1, in which said two (2) lateral side plates have a hand loop pivotally attached thereto and extending there between, said hand loop adapted to hand support said ash drawer in its inverted scoop position.

3. The combination as claimed in claim 2, in which said ash drawer door is comprised of in combination:
   - a front plate hinged upon said furnace device;
   - a door bar integrally attached to said front plate and extending therefrom;
   - a serrated bar attached to said furnace device, said serrations in engaging contact with said bar, whereby said drawer may be incrementally held open to allow an adjustable draft to enter said furnace device.

4. The combination as claimed in claim 3, having a thermometer extending within said hollow rear jacket.

5. The combination as claimed in claim 4, having a pressure sensing device extending within said hollow rear jacket.

6. The combination as claimed in claim 5, having a circulating pump connected to said inlet orifice to circulate said heating medium therein.

7. The combination as claimed in claim 6, in which said heating medium is water.

8. The combination as claimed in claim 6, in which said heating medium is gas.

* * * * *